US006339859B1

(12) United States Patent
Shackford et al.

(10) Patent No.: US 6,339,859 B1
(45) Date of Patent: Jan. 22, 2002

(54) CONTROL SYSTEM FOR A FILTRATE SPLITTING DEVICE

(76) Inventors: Lewis D. Shackford, 8 Riverside Dr., Merrimack, NH (US) 03054; John E. Leddy, 25 Juniper Dr., Amherst, NH (US) 03031

( * ) Notice: Subject to any disclaimer, the term of this patent is extended or adjusted under 35 U.S.C. 154(b) by 0 days.

(21) Appl. No.: 09/344,996

(22) Filed: Jun. 25, 1999

(51) Int. Cl.[7] ..... D06B 3/02

(52) U.S. Cl. ..... 8/156; 68/181 R; 68/184; 162/252

(58) Field of Search ..... 8/156; 68/181 R, 68/184; 162/238, 239, 252, 263

(56) References Cited

U.S. PATENT DOCUMENTS 2,073,654 A * 3/1937 Smiley
2,509,464 A * 5/1950 Weinpel
2,999,785 A * 9/1961 Richter et al.
3,190,790 A * 6/1965 Plotez et al.
3,807,202 A * 4/1974 Gunkel
3,898,124 A * 8/1975 Olson
3,938,206 A * 2/1976 Johannessen
4,014,736 A * 3/1977 Sexton
4,046,621 A * 9/1977 Sexton
4,154,644 A * 5/1979 Ericsson
4,207,141 A * 6/1980 Seymour
4,664,749 A * 5/1987 Haapamaki et al.
4,746,405 A * 5/1988 Lisnyanksy et al.
5,053,123 A 10/1991 Clarke-Pounder et al.
6,086,716 A * 7/2000 Watson et al.

FOREIGN PATENT DOCUMENTS

AU 123590 * 2/1947
RU 565962 * 7/1977

* cited by examiner

*Primary Examiner*—Frankie L. Stinson

(57) ABSTRACT

An adjustable splitter valve and control system for a pulp washing apparatus is provided that automatically regulates the filtrate flow from a pulp washer or thickener to control the filtrate characteristics such as volume, dissolved solids or suspended solids. By detecting or sensing a control parameter in the discharge piping and utilizing a feedback loop, the system will adjust the filtrate split to compensate for variations in the machine operation and feed stock.

23 Claims, 3 Drawing Sheets

CONTROL SYSTEM FOR A FILTRATE SPLITTING DEVICE

FIELD OF THE INVENTION

The present invention relates generally to the pulp and paper industry. More specifically, the present invention relates to apparatuses for washing pulp and, more specifically, to apparatuses for washing pulp which include a plurality of discharge conduits. The present invention is directed toward devices for regulating the flow between the discharge conduits to compensate for variations in the operation of the apparatus and in the feed slurry.

BACKGROUND OF THE INVENTION

In currently used methods of making pulp from wood stock, the wood, which may be in the form of wood chips, is heated in a digester. In the digester, the lignin is chemically dissolved and heated to free the cellulose fibers so they can be reformed into paper. The end product of the digestion process is cooked pulp fibers.

The cooked pulp fibers are then blown into a tank where the steam flashes off. Black liquor is added to the blow tank to dilute the pulp and form a slurry. The pulp slurry is then further diluted and transferred to a pulp washer.

In the pulp washer, a mat or sheet is formed from the slurry and the black liquor is extracted as filtrate. Wash liquor is added to displace the black liquor and is also subsequently extracted. The extracted liquids are recycled to the extent possible and their recycled use depends upon the solids content in the extracted liquid. It is therefore a fairly common practice to "split" the filtrate or extracted liquid into a plurality of discharge conduits, depending upon the solids content in the extracted liquid. For example, in rotating drum filters, it is common to extract the initial black liquor filtrate separately and then split the wash liquor filtrate into "cloudy" or "weak" and "clear" or "strong" streams. Some devices employ a third discharge conduit used to extract a "very clear" stream later in the cycle. In other pulp washers or thickeners, the discharge stream can be split into a number of different discharge streams.

Typically, a movable assembly is provided, referred to as a splitter or splitter valve, that segregates the liquor or filtrate flow into two or more flow streams. Typical prior art splitter valves are either fixed or manually adjustable. As a result, they are installed for a specific set of operating conditions and their performance deteriorates as these conditions change. In most pulp mills, the parameters which affect the most efficient position of the splitter valve can vary constantly and therefore the currently available fixed or manually adjustable splitter valves seldom operate at their optimum setting or position.

Further, when operating a multi-stage washer, increasing the speed of the operation or the speed of rotation of the drum can result in dirty black liquor being carried forward to the subsequent washing stage. As a result, the efficiency of the washing operation is compromised. One condition contributing to the forward movement of black liquor into a second stage or a washing stage is the inappropriate setting of the splitter valve. If the splitter valve were set to permit a sufficient discharge rate of the black liquor, it would not be carried forward into a subsequent washing stage.

Finally, if the splitter valve is not accurately positioned, the concentration of solids in the collected filtrate stream will be adversely affected. Specifically, a "clear" or "weak" stream could result which has an unacceptably high solids concentration. Further, "cloudy" or "strong" streams with unacceptably low solids concentrations could result thereby adversely affecting the system's efficient use of wash liquor and efficient recycling of the various wash liquor discharge streams.

Accordingly, there is a need for an improved system for controlling the position of the splitter valve in pulp washing apparatuses. Improvements in the control of splitter valves in the system will result in faster operation of the apparatuses as well as improved recycling of filtrate streams.

SUMMARY OF THE INVENTION

In satisfaction of the aforenoted needs, the present invention provides an adjustable splitter valve and control system for a pulp washing apparatus that includes a displacement zone for displacing fluid from a pulp mat formed from a pulp slurry and a plurality of discharge conduits for discharging fluid from the displacement zone. The splitter valve and control system includes a movable valve body for directing fluid from the displacement zone to one or more discharge conduits. The valve body is connected to an actuator and the actuator is in communication with a controller. The controller is in communication with at least one sensor disposed in each discharge conduit. The sensors measure at least one physical property of the fluid that flows through each discharge conduit when the valve body is in a position so as to direct fluid through that conduit. Each sensor sends a signal indicating a measured value for the physical property of the fluid flowing through each discharge conduit to the controller. The controller then compares the measured value to a predetermined value range for the respective discharge conduit. In the event the measured value falls outside of a predetermined value range for the conduit or one or more conduits, the controller sends a signal to the actuator to move the valve body to a more appropriate position.

In an embodiment, the sensors measure the conductivity of the fluid flowing through the discharge conduits.

In an embodiment, the sensors measure the solids concentration of the fluid flowing through the discharge conduits.

In an embodiment, the plurality of discharge conduits includes a first conduit for primarily discharging black liquor from the washing apparatus, the black liquor having a high solids concentration and high conductivity. The discharge conduits also include a last conduit for discharging weak, or substantially clean wash liquor from the washing apparatus. The weak, or very clean wash liquor, has a low solids concentration and a low conductivity. The plurality of discharge conduits also include one or more discharge conduits spaced between the first discharge conduit and the last discharge conduit. These additional discharge conduits discharge fluid having a progressively decreased dissolved solids content and a decreased conductivity as the conduits are spaced closer to the last discharge conduit. In other words, the discharge conduit disposed immediately adjacent to the first discharge conduit discharges fluid having a relatively high dissolved solids content and high conductivity in comparison to the fluid discharged by the discharge conduit disposed immediately adjacent to the last discharge conduit.

In an embodiment, the present invention provides a method for controlling the position of a filtrate splitting device in a pulp washer that includes a plurality of discharge conduits as described above, each conduit including a sensor that is in communication with a controller, the controller being in communication with an actuator that translates signals from the controller to a repositioning movement of the splitter valve. The method includes the steps of measuring a physical property of the fluid being discharged from one or more of the discharge conduits, transmitting a signal reflective of the measured value to the controller, comparing the measured value with a predetermined operating range and, in the event the measured value falls out of the predetermined optimal range, sending a signal to the actuator to thereafter reposition the splitter valve.

In an embodiment, the sensors measure the conductivity of the fluid being discharged through each conduit and send a signal reflective of the measured conductivity to the controller. The controller then compares the measured conductivity value with a preferred conductivity range for each discharge conduit. If the measured value in the first conduit is less than the preferred range, the controller sends a signal to the actuator to move the splitter valve towards the first discharge conduit so that less of the lower conductivity (low solids concentration) fluid is discharged to the first conduit. In the event the measured conductivity value in the first conduit is higher than the preferred conductivity range for the respective discharge conduit, the controller sends a signal to the actuator to move the splitter valve towards the second discharge conduit to thereby reduce the amount of the low conductivity (low solids concentration) fluid being discharged to the first conduit from the pulp washer and to thereby minimize the rate at which wash liquor is consumed. In both cases, the splitting of high and low solids concentration liquors is optimized.

In an embodiment, as the splitter valve moves from the first discharge (black liquor) conduit towards the last (very weak) discharge conduit, the percentage of weak liquor or filtrate that is removed from the pulp washer decreases. As a result, a smaller quantity of wash liquor is utilized in the pulp washer.

It is therefore an advantage of the present invention to provide an improved method of controlling the position of a splitter valve for a pulp washer.

Another advantage of the present invention is that it reduces the use of clean wash liquor in pulp washers.

Another advantage of the present invention is that it more efficiently splits the filtrates and liquors discharged from a pulp washer for a more efficient recycling of these materials.

Yet another advantage of the present invention is that it enables pulp washers to be operated at a faster rate.

Still another advantage of the present invention is that it enables pulp washers to be operated at higher efficiencies.

These and other objects and advantages of the present invention will become apparent upon reading the following detailed description and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
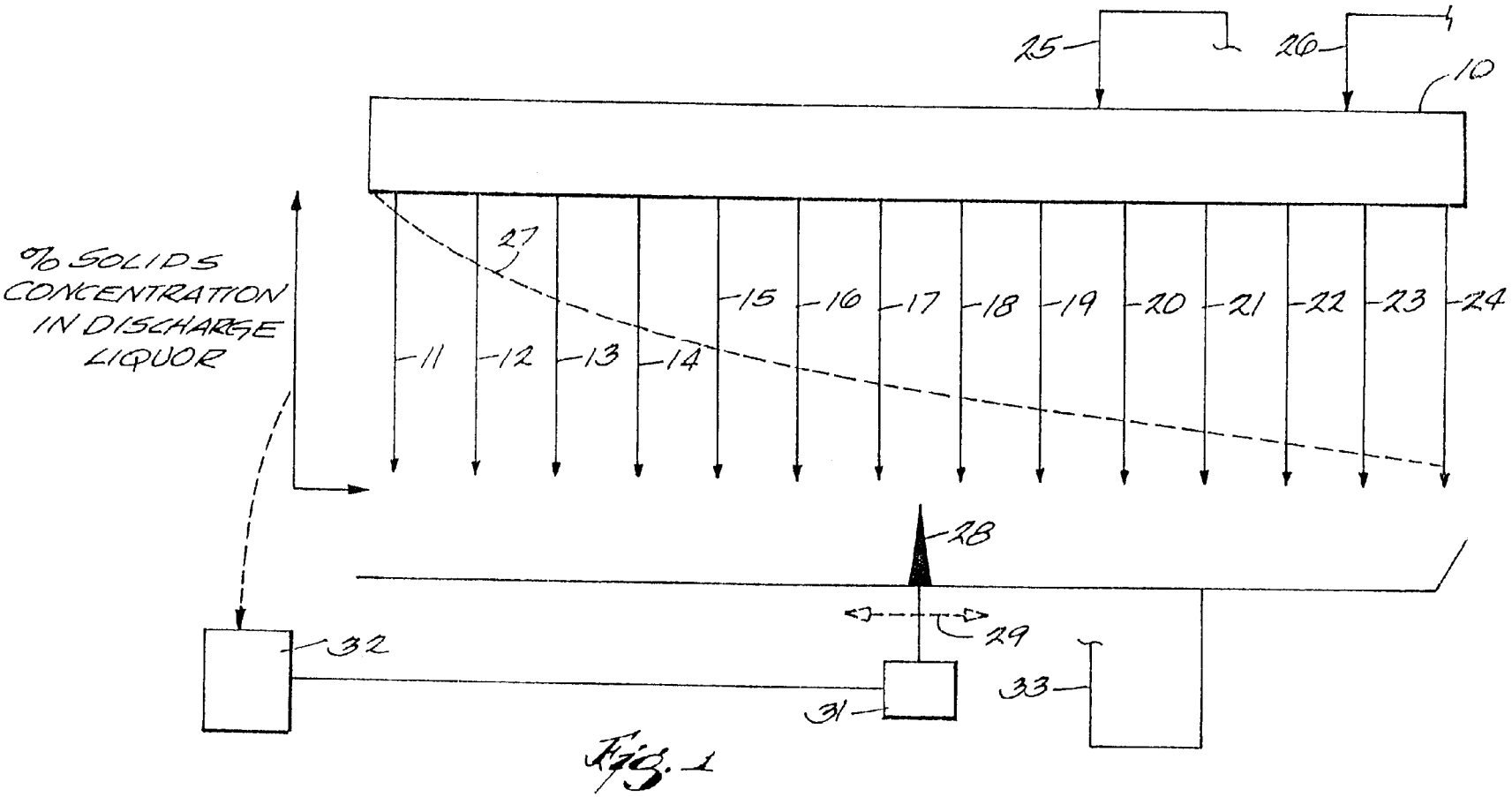
FIG. 1 is a schematic illustration of the adjustable splitter valve and control system therefor as incorporated into the discharge piping of a pulp washing apparatus.

Turning first to FIG. 1, a pulp washing apparatus shown schematically at 10 which includes a plurality of discharge pipes shown at 11–24. It will be known that the number of discharge pipes for a pulp washer 10 may vary greatly. Some pulp washers include as little as two discharge pipes; others include as many as the fourteen illustrated in FIGS. 1 and 2 or more. In addition to a pulp slurry inlet (not shown), the pulp washer 10 also includes a first wash liquor feed 25 and a second wash liquor feed 26. The pulp washer 10 may be any type of pulp washer, including the rotating filter types such as the drum filters or disc filters. The discharge conduit 11, shown at the left in FIGS. 1 and 2, will be hereinafter referred to as the first discharge conduit 11 because it is the conduit that discharges primarily black liquor or other high solids concentration filtrate that has been displaced from the pulp mat (not shown) in the washer 10. The liquor filtrate discharged by the first discharge conduit 11 has a high solids content and high conductivity.

In contrast, the last discharge conduit 24 is intended to discharge primarily weak or "very weak" liquor or filtrate having a low solids concentration and a low conductivity. The discharge conduits 12–23 disposed between the first discharge conduit 11 and the last discharge conduit 24 discharge filtrate having decreasing solids concentrations and decreasing conductivity from left to right in FIGS. 1 and 2. That is, the discharge conduit 12, which is disposed immediately adjacent to the first discharge conduit 11, discharges fluid having a higher solids concentration and a higher conductivity than the discharge conduit 23, which is disposed immediately adjacent to the last discharge conduit 24. The relationship between the decreasing solids concentrations from left to right in FIG. 1 is illustrated by the line shown at 27.

In order to adjust the split between one, two or more conduits 11–24, a movable splitter valve 28 is provided. The splitter valve 28 can be moved in both the left and right directions as indicated by the arrow 29. Movement of the splitter valve 28 is actuated by the actuator 31 which is in communication with a controller 32. A cumulative discharge conduit is shown at 33 which can be used to collect the discharge filtrate. Also, the discharge conduits 11–24 may be connected to separate receiving receptacles or fluid handling systems (not shown).

Figure 2:
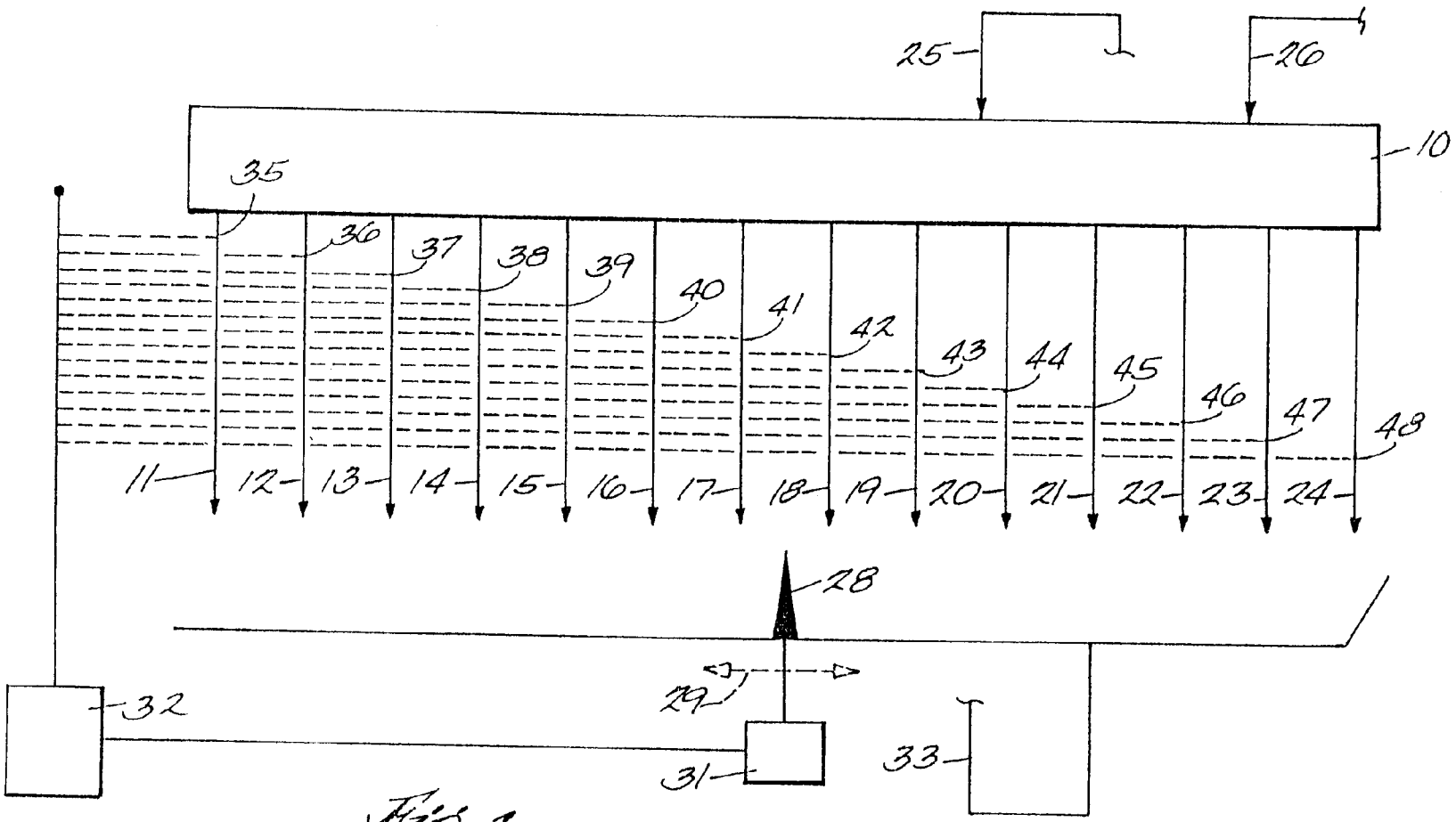
FIG. 2 is another schematic illustration of the adjustable splitter valve and control system of the present invention as incorporated into the discharge piping system of a pulp washing apparatus, particularly illustrating the communication between sensors disposed in each discharge conduit and the controller.

Turning to FIG. 2, the controller 32 is in communication with a plurality of sensors for each discharge conduit 11–24, the sensors being shown schematically at 35–48. Each sensor 35–48 can measure a physical property of the filtrate or fluid being discharged through the conduit 11–24. For example, each sensor 35–48 can measure the conductivity (or resistivity) of the filtrate being discharged. A signal is generated and sent to the controller 32. The controller 32 preferably has a memory in which acceptable conductivity ranges for the conduits 11–24 is stored. By way of an example, if the conductivity measured by the sensor 41 for the discharge conduit 17 is greater than the preferred range stored in the controller 32 for the discharge conduit 17, the controller will send a signal to the actuator 31 to move the splitter valve 28 to the right which will result in an increase in the percentage of strong filtrate being discharged from the pulp washer 10. One preferred movement would be to move the splitter valve 28 between the discharge conduits 18 and 19 in this occurrence.

Also, by way of an example, if the sensor 42 for the discharge conduit 18 measures a conductivity value that is less than the preferred conductivity range stored in the controller 32 for the discharge conduit 18, the controller 32 will send a signal to the actuator 31 to move the splitter valve 28 to the left which will result in a decrease in the percentage of strong filtrate being discharged from the pulp washer 10. Accordingly, if the measured conductivity values are too low for the specific discharge conduits being measured, the valve 28 will be moved to the left to withdraw less of the low conductivity (weak) filtrate from the washer 10. If the measured conductivity values are high, the splitter valve 28 will be moved to the right resulting in a reduction of the weak filtrate discharge and a more efficient use of the wash liquor.

Figure 3:
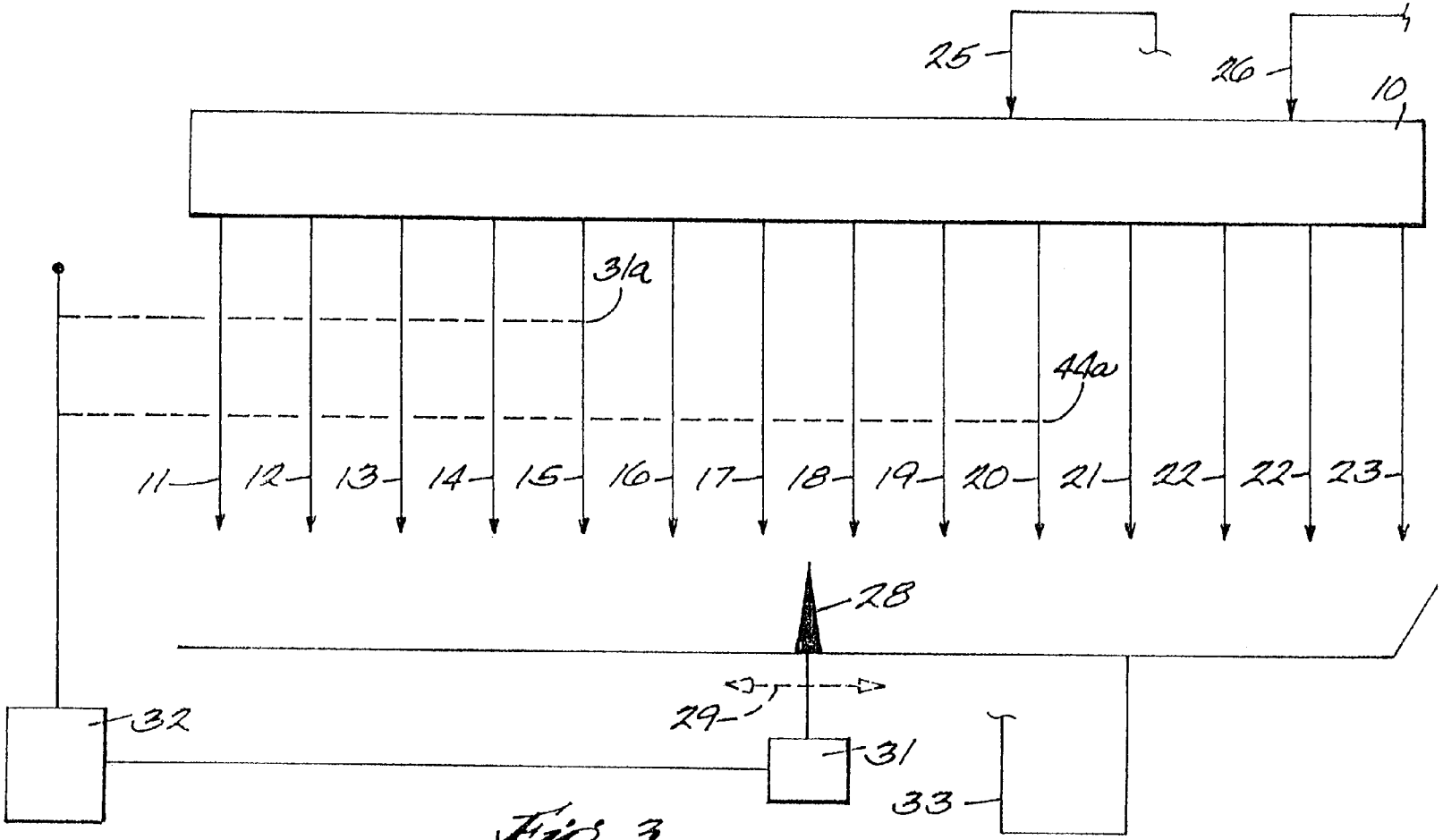
FIG. 3 is a schematic illustration of another embodiment of the present invention employing two sensors, one on either side of the splitter valve.

FIG. 3 is an illustration of a simplified and therefore less expensive embodiment of the present invention that employs two sensors 31*a* and 44*a* on conduits 15 and 20 respectively. The embodiment illustrating the use of fourteen sensors shown in FIG. 2 is anticipated to be useful for experimental purposes and, unless the economics of conductivity sensors changes, it is anticipated that the use of less than fourteen sensors would be preferable. Therefore, the use of two sensors, one on either side of the splitter valve 28 is substantially more feasible than the design shown in FIG. 2. Further, the present invention can be carried out using only one sensor disposed on either side of the splitter valve 28. Therefore, the present invention can be carried out with as little as one sensor.

From the above description, it is apparent that the objects and advantages of the present invention have been achieved. While only certain embodiments have been set forth, alternative embodiments and various modifications will be apparent from the above description to those skilled in the art. For example, the number of discharge conduits can vary greatly. Further, in addition to pulp washers, the present invention applies to other washing apparatuses as well and, therefore, black liquor may not be the filtrate that is initially displaced in the washer, but other types of dirty liquor or filtrate may be initially displaced as well. Also, in addition to conductivity, resistivity or fluent clarity can be measured in order to estimate the solids concentration or suspended solids of the discharge liquor. Any measurement that provides an indication of the solids concentration of the discharge liquor can be utilized. These and other alternatives are considered equivalents and within the spirit and scope of the present invention.

What is claimed:

1. An adjustable splitter valve and control system for a pulp washing apparatus that includes at least one of a displacement zone and an extraction zone for displacing fluid from a pulp mat and a plurality of discharge conduits for discharging fluid from the zone, the splitter valve and control system comprising:

a moveable valve body for directing fluid from the zone to one or more of the discharge conduits, the valve body being connected to an actuator, the actuator being in communication with a controller, the controller being in communication with at least one sensor disposed in at least one discharge conduit, the at least one sensor measuring at least one physical property of the fluid that flows through the discharge conduit when the valve body directs fluid through said discharge conduit, the at least one sensor sending a signal indicating a measured value for the measured physical property for each discharge conduit, the controller comparing the measured value to a predetermined or calculated value range for the respective discharge conduit, in the event the measured value falls outside of a predetermined or calculated value range for one or more discharge conduits, the controller sending a signal to the actuator to move the valve body.

2. The splitter valve and control system of claim 1 wherein the measured physical property is conductivity.

3. The splitter valve and control system of claim 1 wherein the measured physical property is dissolved solids concentration.

4. The splitter valve and control system of claim 1 wherein the measured physical property is suspended solids concentration.

5. The splitter valve and control system of claim 4 wherein the measured physical property is conductivity.

6. The splitter valve and control system of claim 4 wherein the measured physical property is resistivity.

7. The splitter valve and control system of claim 6 wherein the measured physical property is conductivity.

8. The splitter valve and control system of claim 4 wherein the measured physical property is solids concentration.

9. The splitter valve and control system of claim 1 wherein the measured physical property is color solids concentration.

10. An adjustable splitter valve and control system for a pulp washing apparatus that includes at least one of a displacement zone and an extraction zone where filtrate and wash liquor are displaced from a pulp mat, at least one inlet for introducing wash liquor to the zone and a plurality of discharge conduits for discharging filtrate and/or wash liquor from the zone, the plurality of discharge conduits capable of discharging filtrate and/or wash liquor having various solids concentrations, the plurality of discharge conduits including a first discharge conduit for discharging primarily filtrate at a high solids concentration, a last discharge conduit for discharging primarily clean wash liquor at a low solids concentration and at least one discharge conduit disposed between the first and last discharge conduits for discharging filtrate and/or wash liquor at flowrates and solids concentrations that are less than the flowrate and solids concentration of the first discharge conduit and greater than the flowrate and solids concentration of the last discharge conduit, the splitter valve and control system comprising:

a moveable valve body for directing filtrate and/or wash liquor from the zone to one or more of the discharge conduits, the valve body being connected to an actuator, the actuator being in communication with a controller, the controller being in communication with at least one sensor disposed in at least one discharge conduit, the sensors measuring a physical property of the filtrate that flows through each discharge conduit when the valve body directs filtrate through said discharge conduit, a signal indicating a measured value for the measured physical property for at least one discharge conduit, the controller comparing the measured value to a calculated or predetermined value range for the respective discharge conduit, in the event the measure value falls outside of the calculated or predetermined value range for one or more discharge conduits, the controller sending a signal to the actuator to move the valve body in response to the comparisons of measured values to calculated or predetermined value ranges for one or more discharge conduits.

11. An adjustable splitter valve and control system for a pulp washing apparatus that includes at least one of a displacement zone and an extraction zone, the splitter valve for draining fluid displaced or extracted from a pulp mat, at least one inlet for introducing fluid into the zone and a plurality of discharge conduits linearly aligned in a row for discharging fluid from the zone, the splitter valve and control system comprising:

a moveable valve body for directing fluid from the zone to one or more of the discharge conduits, the valve body being connected to an actuator, the actuator being in communication with a controller, the controller being in communication with at least one sensor disposed in at least one discharge conduit, the sensors measuring at least one physical property of the fluid that flows through the at least one discharge conduit when the valve body directs fluid through said discharge conduit, each sensor sending a signal indicating a measured value for the measured physical property for the at least one discharge conduit, the controller comparing the measured value to a calculated or predetermined value range for the at least one discharge conduit, in the event the measured value falls outside of the calculated or predetermined value range for the at least one discharge conduit, the controller sending a signal to the actuator to move the valve body along the row of discharge conduits to redirect the flow of fluid from the zone to different discharge conduits in response to the comparisons of measured values to predetermined value ranges for the at least one discharge conduits.

12. The splitter valve and control system of claim 11 wherein the measured physical property is suspended solids concentration.

13. The splitter valve and control system of claim 11 wherein the measured physical property is color solids concentration.

14. The splitter valve and control system of claim 11 wherein the measured physical property is resistivity.

15. The splitter valve and control system of claim 11 wherein the measured physical property is solids concentration.

16. A method of regulating fluid flow discharged from at least one of a displacement zone and extraction zone of an apparatus for washing pulp, the method comprising the following steps:

providing at least one group of discharge conduits for discharging filtrate and/or wash liquor from the zone, the group of discharge conduits for discharging filtrate and/or wash liquor having varying solids concentrations, the group of discharge conduits including a first discharge conduit for discharging primarily filtrate at a high flowrate and a high solids concentration and a last discharge conduit for discharging primarily clean wash liquor at a low flowrate and a low solids concentration and at least one discharge conduit disposed between the first and last discharge conduits for discharging filtrate and/or wash liquor at flowrates and solids concentrations that are less than the flowrate and solids concentration of the first discharge conduit and greater than the flowrate and solids concentration of the last discharge conduit, providing a movable splitter valve that can direct fluid flow from the zone to one or more of the discharge conduits, measuring a physical property for the fluid being discharged from the one or more of the discharge conduits and generating a measured value for one or more discharge conduits, comparing the measured value with an acceptable value range for the one or more discharge conduits, in the event the measured value for the one or more discharge conduits falls outside the acceptable value range for the one or more of the discharge conduits, moving the valve body to redirect the flow of fluid to a different discharge conduit combination.

17. The method of claim 16 wherein the measured physical property is conductivity.

18. The splitter valve and control system of claim 16 wherein the measured physical property is suspended solids concentration.

19. The splitter valve and control system of claim 16 wherein the measured physical property is color solids concentration.

20. The method of claim 16 wherein the measured physical property is resistivity.

21. The method of claim 16 wherein the measured physical property is solids concentration.

22. The method of claim 16 wherein the discharge conduits are arranged linearly in a row.

23. A method of controlling a rate of discharge of filtrate and/or wash liquid in a pulp washing apparatus that includes at least one of a displacement zone and an extraction zone where filtrate and wash liquor is displaced or extracted from a pulp mat, at least one inlet for introducing wash liquor to the zone and a group of discharge conduits for discharging filtrate and/or wash liquor from the zone, the group of discharge conduits for discharging filtrate and/or wash liquor having varying solids concentrations, the plurality of discharge conduits including a first discharge conduit for discharging primarily filtrate at a high flow rate and a high solids concentration and a last discharge conduit for discharging primarily clean wash liquor at a low flowrate and a low solids concentration, a moveable splitter valve for directing filtrate and/or wash liquor from the zone to one or more of the discharge conduits, the splitter valve being connected to an actuator, the actuator being in communication with a controller, the controller being in communication with at least one sensor disposed in each discharge conduit, the method comprising the following steps:

measuring the conductivity of the filtrate and/or wash liquor that flows through at least one discharge conduit with the sensor disposed in each of the discharge conduit when the splitter valve directs filtrate and/or wash liquor through said discharge conduit, sending a signal from the sensor to the controller indicating a measured value for the conductivity for the at least one discharge conduit, comparing the measured value to a predetermined acceptable conductivity range for the at least one discharge conduit, in the event the measure value falls above the predetermined acceptable conductivity range for at least one discharge conduits, sending a signal from the controller to the actuator to move the splitter valve towards the last discharge conduit, in the event the measure value falls below the predetermined acceptable conductivity range for at least one discharge conduits, sending a signal from the controller to the actuator to move the splitter valve towards the first discharge conduit.

* * * * *